US006579058B1

(12) United States Patent
Sales, Jr.

(10) Patent No.: US 6,579,058 B1
(45) Date of Patent: Jun. 17, 2003

(54) SIDE-DUMPING LOADER

(76) Inventor: Frank Sales, Jr., 68 Cannon Rd., Windsor Locks, CT (US) 06096

( * ) Notice: Subject to any disclaimer, the term of this patent is extended or adjusted under 35 U.S.C. 154(b) by 24 days.

(21) Appl. No.: 09/470,471

(22) Filed: Dec. 22, 1999

(51) Int. Cl.[7] ..... E02F 3/28
(52) U.S. Cl. ..... 414/726; 414/722
(58) Field of Search ..... 414/722, 723, 414/726

(56) References Cited

U.S. PATENT DOCUMENTS 3,523,622 A 8/1970 Burcham et al.
3,531,007 A 9/1970 Leijon
3,556,330 A 1/1971 Keskitalo et al.
3,599,819 A 8/1971 Leijon
3,626,612 A * 12/1971 Liebrecht ..... 414/726
3,885,694 A 5/1975 Uchida et al.
4,220,438 A 9/1980 Anderson, Jr.
5,141,288 A 8/1992 Smith
5,921,743 A 7/1999 Slagter

* cited by examiner

*Primary Examiner*—Donald W. Underwood
(74) *Attorney, Agent, or Firm*—Cantor Colburn LLP

(57) ABSTRACT

A side-dumping loader comprising a dump bucket, a cradle for supporting said bucket, a pintle serving as a point of attachment between said cradle and said dump bucket, a hydraulic assembly comprising a cylinder portion and rod portion, wherein said cylinder portion is attached to said cradle and said rod portion is attached to said dump bucket, wherein the rod portion, when extended, causes said dump bucket to rotate at said pintle, from a horizontal position to a sloped position.

2 Claims, 4 Drawing Sheets

SIDE-DUMPING LOADER

BACKGROUND OF THE INVENTION

This invention relates to skid steer loader vehicles and more particularly to side dump buckets for dumping material to the side of a loader. Buckets of the kind attached at the front of a skid steer loader vehicle generally have a dumping mechanism which provides for tilting the bucket forwardly. In many working situations, it may be undesirable or impossible to maneuver the vehicle into a position for forward dumping. As a result, side dump buckets have been developed to facilitate the unloading of material to one side of the loader vehicle.

Side dump buckets presently available generally require roll back of the loader frames for use. Such roll back is impractical with skid steer loaders due to their relatively small size. Moreover, side dump buckets of the prior art tend to move, at least to some degree, outward from the front of the vehicle rather than directly upward from the side of the vehicle.

SUMMARY OF INVENTION

The disadvantages and shortcomings of the prior art are overcome by utilizing a side dumping loader comprising a dump bucket, a cradle for supporting said bucket, a pintle serving as a point of attachment between said cradle and said dump bucket, a hydraulic assembly comprising a cylinder portion and rod portion, wherein said cylinder portion is attached to said cradle and said rod portion is attached to said dump bucket, wherein the rod portion, when extended, causes said dump bucket to rotate at said pintle, from a horizontal position to a sloped position. Other features and advantages of the present invention will be appreciated and understood by those of ordinary skill in the art from the following drawings and detailed description.

DESCRIPTION OF THE DRAWINGS

The side dumping loader will now be described, by way of example only, with reference to the accompanying drawings, which are meant to be exemplary, not limiting, and wherein like elements are numbered alike in several FIGURES, in which.

DETAILED DESCRIPTION OF THE INVENTION

Figure 1:
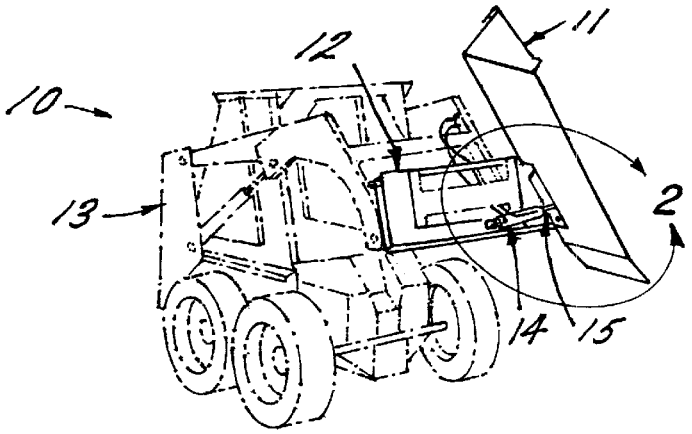
FIG. 1, is a frontal view of a skid steer loader with a side dump bucket in dumping position.
Figure 2:
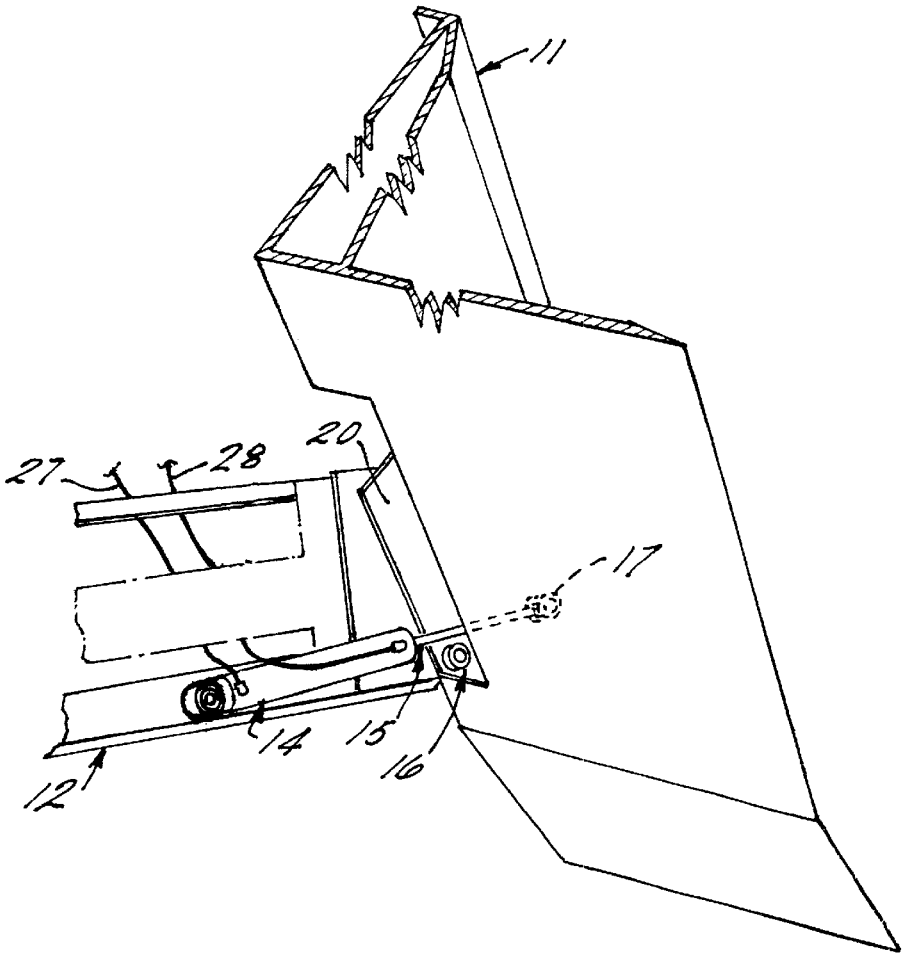
FIG. 2, is a frontal view of a side dump bucket in dumping position.

Referring initially to FIG. 1, there is shown a skid steer loader 10 with a loader bucket 11 supported on a cradle 12 which is carried on the ends of parallel spaced apart lift arms 13 which may be raised and lowered, suitable structure for the lift arms as well as the remainder of the loader vehicle being well known in the art. The bucket 11 is in position for side dumping as shown. Side dumping is facilitated with a hydraulic assembly, comprising a hydraulic cylinder 14 and a hydraulic cylinder rod 15, wherein rod 15 is extended, causing bucket 11 to pivot from a horizontal position to a sloped position. Design and operation of the hydraulic assembly is well known in the art. As shown in FIG. 2, fluid under pressure is introduced through line 27, causing hydraulic cylinder rod 15 to extend and raise bucket 11 from a horizontal position to a sloped position. Fluid can be removed from the cylinder 14 via line 28, causing hydraulic cylinder rod 15 to retract, thus returning bucket 11 to a horizontal position.

Referring again to FIG. 2, bucket 11 of the side-dump loader may further comprise a recess 20 on the under side of bucket 11 The recess 20 and the hydraulic cylinder 14 are aligned so that the hydraulic cylinder 14 is enclosed within the recess 20 when bucket 11 is in a horizontal position. Enclosure of the hydraulic cylinder 14 within the recess 20 is desirable, as it affords protection to the cylinder 14 and accompanying lines and attachments.

Figure 3:
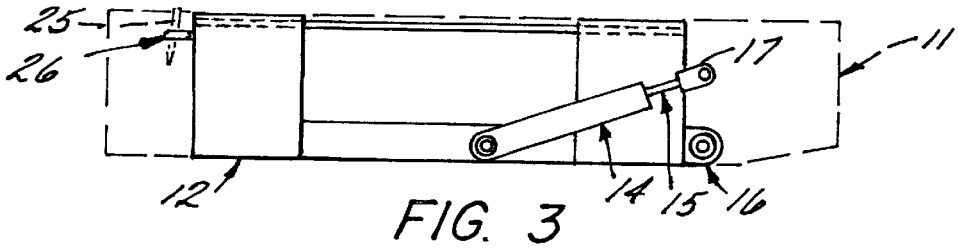
FIG. 3, is a frontal view of a side dump bucket in a lowered position.

Referring now to FIG. 3, the side dump loader may further comprise a pin 25 attached to dump bucket 11, and a ring 26 attached to cradle 12. Pin 25 and ring 26 are aligned so that pin 25 is inserted within ring 26 when dump bucket 11 is in the horizontal position, thus providing a securing means.

Figure 4:
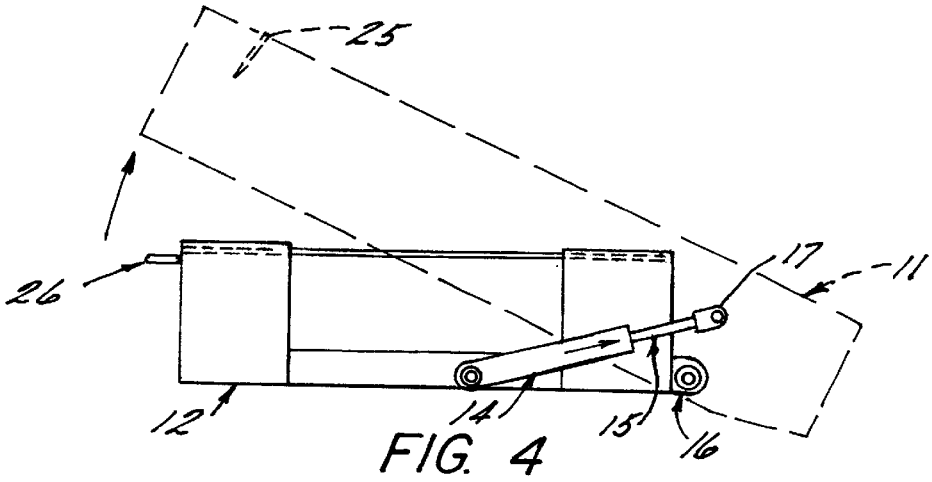
FIG. 4, is a frontal view of a side dump bucket in a slightly raised position.
Figure 5:
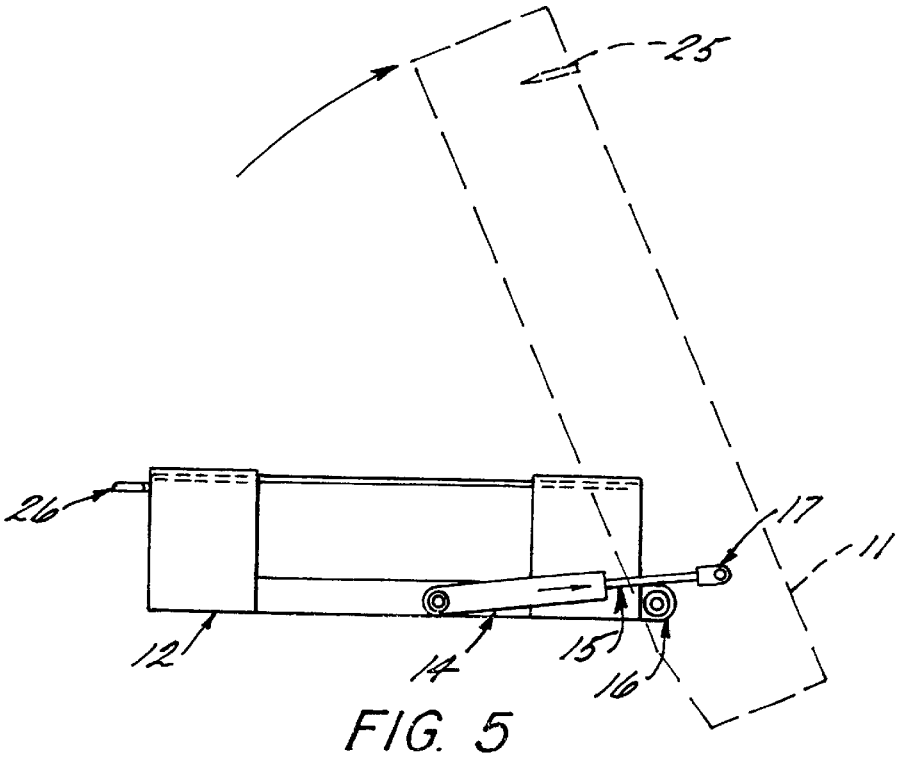
FIG. 5, is a frontal view of a side dump bucket in a raised position.

The operation of the side dumping loader may be further understood upon reference to FIGS. 3, 4, and 5, which show loader operation from a frontal view. Referring particularly to FIG. 3, prior to the initiation of the dumping mechanism, the dump bucket 11 is in a horizontal position. Side dumping is enabled by the extension of the hydraulic cylinder rod 15, which is secured to the rear of bucket 11 at a point 17. Rod 15 may be secured to the bucket 11 at point 17 by any means suitable to provide a durable connection, including, but not limited to, a screw, a bolt, or by welding. Referring now to FIG. 4, extension of the rod 15 causes the bucket 11 to rotate upwardly, around pintle 16, from a horizontal position to a sloped position. Upward rotation may continue until bucket 11 is in a vertical or near vertical position, as shown in FIG. 5, thus effecting dumping of the contents of the bucket 11 to the side of the loader.

Figure 6:
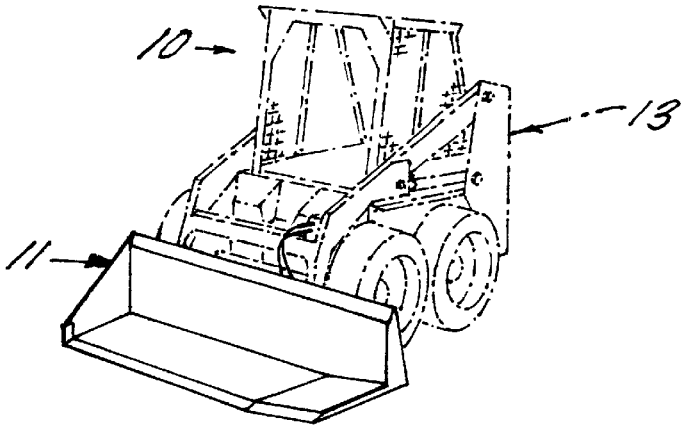
FIG. 6, is a frontal view of a skid steer loader and a side dump bucket in a lowered position.
Figure 7:
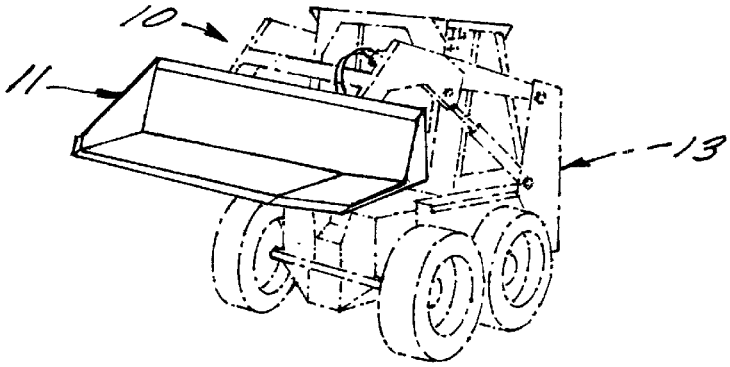
FIG. 7, is a frontal view of a skid steer loader with a side dump bucket in a lowered position and lift arms in a raised position.
Figure 8:
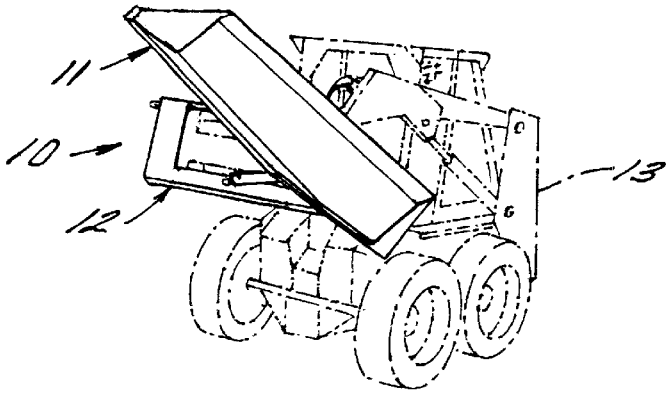
FIG. 8, is a frontal view of a skid steer loader with a side dump bucket in raised position and lift arms in raised position.
Figure 9:
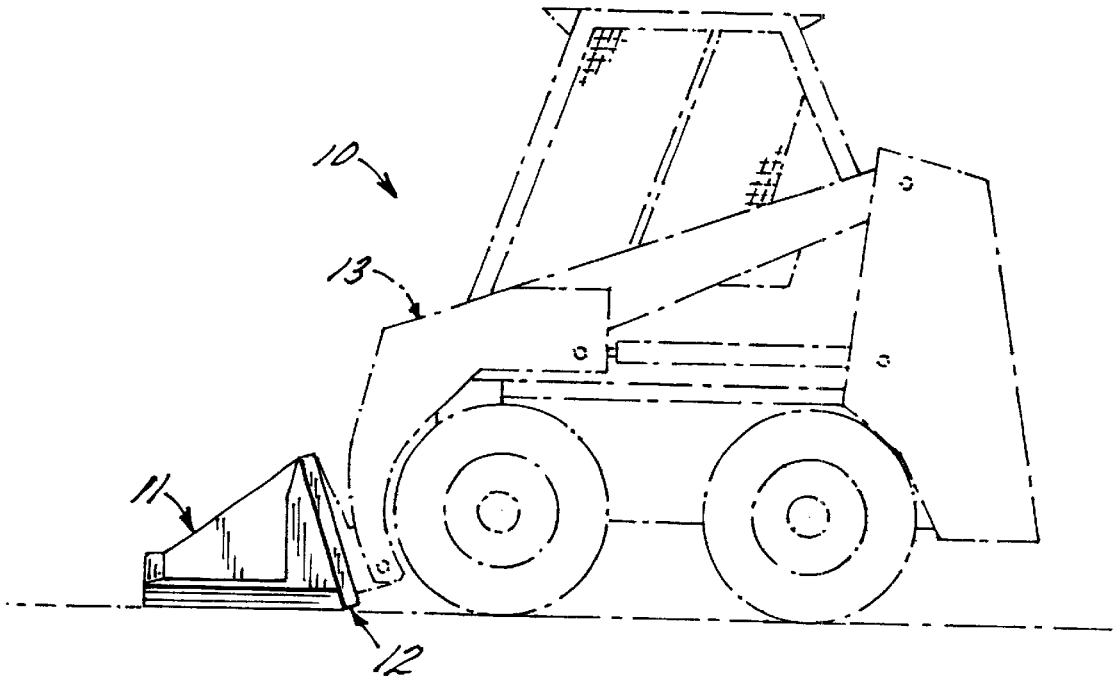
FIG. 9, is a side view of a skid steer loader with side a dump bucket in lowered position and lift arms in lowered positions.

The side dumping loader may be used in conjunction with parallel lift arms, as shown in FIGS. 6, 7 and 8. Referring to FIG. 6, bucket 11 is shown in a horizontal position at ground level, and thus is in a position to scoop material from the ground for dumping. Once bucket 11 is loaded with material for dumping, parallel lift arms 13 may be engaged so as to elevate bucket 11, as shown in FIG. 7. Referring to FIG. 8, when a desired elevation is reached, the side dumping mechanism may be engaged, as described above, causing bucket 11 to rotate to a vertical or near vertical position, causing the contents of bucket 11 to fall to the side of the loader 10.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A side dumping loader comprising:

a.) a skid steer loader with a dump bucket attached thereto;

b.) a cradle for supporting said dump bucket;

c.) a pintle, serving as a point of attachment between said cradle and said dump bucket;

d.) a hydraulic assembly comprising a cylinder portion and rod portion, wherein said cylinder portion is attached to said cradle and said rod is attached to said dump bucket; wherein the rod portion, when extended, causes said dump bucket to rotate at said pintle, from a horizontal position to a sloped position;

e.) a recess in said dump bucket, positioned so as to enclose said hydraulic cylinder when the bucket is in a horizontal position.

2. A side dumping loader in accordance with claim 1, further comprising a pin attached to said bucket and a ring attached to said cradle, wherein said pin and said ring are aligned so that said pin is inserted in said ring when said bucket is in a horizontal position.

* * * * *